US006456821B2

(12) United States Patent
Onodera

(10) Patent No.: US 6,456,821 B2
(45) Date of Patent: Sep. 24, 2002

(54) IMAGE FORMING APPARATUS FOR SYNTHETIC RESIN SHEETS

(75) Inventor: Noboru Onodera, Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 0 days.

(21) Appl. No.: 09/858,507

(22) Filed: May 17, 2001

(30) Foreign Application Priority Data

May 17, 2000 (JP) ..... 2000-144883
Jul. 26, 2000 (JP) ..... 2000-225269

(51) Int. Cl.[7] ..... G03G 15/00
(52) U.S. Cl. ..... 399/388; 399/405
(58) Field of Search ..... 271/3.19, 3.23; 399/124, 373, 378, 388, 400, 401, 405; 430/126

(56) References Cited

U.S. PATENT DOCUMENTS 4,831,419 A * 5/1989 Iaia, Jr. et al. ..... 399/388
6,233,424 B1 * 5/2001 Mohri et al. ..... 399/320
6,304,742 B1 * 10/2001 Nunes et al. ..... 399/361

FOREIGN PATENT DOCUMENTS

| | | |
|---|---|---|
| JP | 5-212857 | 8/1993 |
| JP | 11-167312 | 6/1999 |
| JP | 11-305560 | 11/1999 |

* cited by examiner

*Primary Examiner*—Hoang Ngo
(74) *Attorney, Agent, or Firm*—Oblon, Spivak, McClelland, Maier & Neustadt, P.C.

(57) ABSTRACT

An image forming apparatus for forming an image on an optical disk or similar synthetic resin sheet is disclosed. The image forming apparatus feeds and collects the synthetic resin sheet from a conveyance path at the same position. A single space therefore suffices for both of the feed and collection of the synthetic resin sheet, promoting the compact configuration of the apparatus. The conveyance path is inclined relative to the horizontal plane and therefore saves space to thereby promote the efficient use of a limited floor area.

38 Claims, 10 Drawing Sheets

IMAGE FORMING APPARATUS FOR SYNTHETIC RESIN SHEETS

BACKGROUND OF THE INVENTION

The present invention relates to an image forming apparatus for forming images on optical disks or similar synthetic resin sheets.

A family of synthetic resin sheets extensively used today include CD-ROM (Compact Disk Read Only Memory), CD-R (CD Recordable), CD-RW (CD ReWritable), MO (MagnetOptical disk), DVD (Digital Versatile Disk), cash cards, IC (Integrated Circuit) card, ID (identification) cards, and telephone cards. It is a common practice to print necessary information on the protection layer surface of a synthetic resin sheet by screen printing or offset printing. However, the problem with an image forming process using screen printing or offset printing is that an extra step of making a master is essential. The master making step degrades efficiency and increases cost when it comes to on-demand image formation, i.e., when a small amount of, but many different kinds of, images must be produced within a short term. While an ink jet printer is another implementation applicable to synthetic resin sheets, it takes a long period of time to form images, makes the sheets difficult to handle due to the slow drying of ink, and cannot provide images with durability.

In light of the above, Japanese Patent Laid-Open Publication Nos. 5-212857 and 11-167312, for example, discloses an electrophotographic image forming apparatus constructed to form images on synthetic resin sheets like e.g., a copier. In the image forming apparatus, a disk feeder loads a table with a synthetic resin sheet. While a conveyor conveys the table from the upstream side toward the downstream side, a toner image is transferred from an image carrier included in an image forming section to the synthetic resin sheet at an image transfer position. The toner image is then fixed on the synthetic resin sheet at a fixing position. A disk collector picks up the synthetic resin sheet carrying the fixed toner image thereon from the table. In this manner, the table and therefore the synthetic resin sheet is conveyed along a horizontal, linear path. The disk feeder and disk collector are respectively located at opposite ends of the horizontal path.

The problem with the above-described conventional apparatus is that a substantial, exclusive space must be allocated to each of the disk feeder, conveyor and disk collector. This, coupled with substantial spaces allocated to the image forming section and fixing section, makes the entire apparatus bulky, particularly in the direction of conveyance. Consequently, the apparatus occupies a great space and therefore a great floor area.

Technologies relating to the present invention are also disclosed in, e.g., Japanese Patent Laid-Open Publication No. 11-305560.

SUMMARY OF THE INVENTION

It is therefore an object of the present invention to provide a compact image forming apparatus for synthetic resin sheets capable of promoting the efficient use of a limited space and therefore a limited floor area.

In accordance with the present invention, an image forming apparatus includes an image carrier, an image forming section for forming a toner image on the image carrier, a conveyor for conveying a synthetic resin sheet, an image transferring device for transferring the toner image from the image carrier to the synthetic resin sheet, and a fixing device for fixing the toner image on the synthetic resin sheet. The conveyor has a conveyance path inclined relative to a horizontal plane.

Also, in accordance with the present invention, an image forming apparatus includes an image carrier, an image forming section for forming a toner image on the image carrier, a conveyor for conveying a synthetic resin sheet along a preselected path, an image transferring device for transferring the toner image from the image carrier to the synthetic resin sheet being conveyed by the conveyor, and a fixing device for fixing the toner image on the synthetic resin sheet. The conveyor is constructed such that the synthetic resin sheet is fed and collected from the conveyance path at the same position.

BRIEF DESCRIPTION OF THE DRAWINGS

The above and other objects, features and advantages of the present invention will become more apparent from the following detailed description taken with the accompanying, drawings in which:

FIG. 3A is a front view showing path switching means included in the illustrative embodiment in a condition wherein an electromagnetic solenoid is turned on;

DESCRIPTION OF THE PREFERRED EMBODIMENTS

Figure 1:
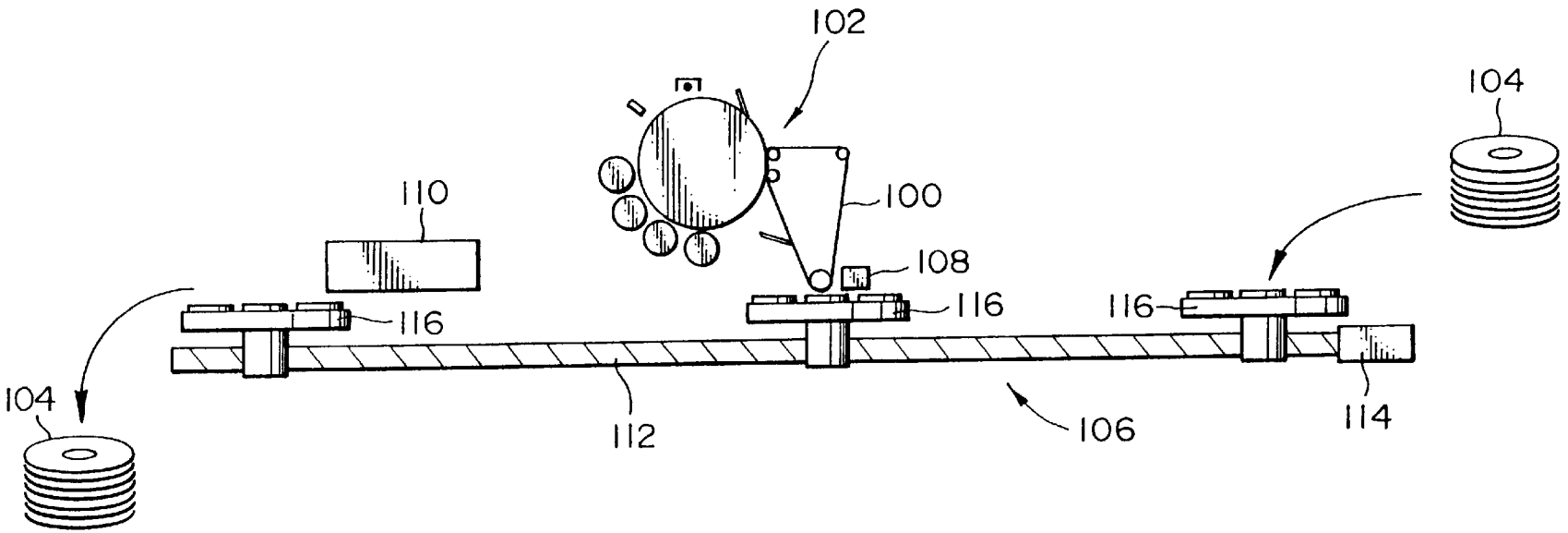
FIG. 1 PRIOR ART
FIG. 1 is a view showing a conventional image forming apparatus for synthetic resin sheets.

To better understand the present invention, brief reference will be made to a conventional electrophotographic image forming apparatus for synthetic resin sheets. As shown, the image forming apparatus includes an intermediate image transfer belt (simply belt hereinafter) 100, which is a specific form of an image carrier. An image forming section 102 forms a toner image on the belt 100. A conveyor 106 conveys an optical disk or similar synthetic resin sheet (disk hereinafter) 104. An image transferring device 108 transfers the toner image from the belt 100 to the disk 104. A fixing unit 110 fixes the toner image on the disk 104. A table 116 is mounted on a horizontal ball screw 112. A servo motor 114 drives the ball screw 112 in order to move the table 116 on and along the ball screw 112. A disk feeder, not shown, and a disk collector, not shown, are respectively located upstream and downstream of the conveyor 106 in the direction of disk conveyance.

In operation, the disk feeder loads the table 116 with the disk 104. The conveyor 106 conveys the table 116 loaded with the disk 104 toward an image transfer position where the image transferring device 108 is located. The image transferring device 108 electrostatically transfers a toner image from the belt 100 to the disk 104. The conveyor 106 further conveys the disk 104 carrying the toner image thereon to the fixing unit 110. The fixing unit 110 fixes the toner image on the disk 104 with heat and pressure. Finally, the disk collector picks up the disk 104 from the table 116.

As stated above, the conventional image forming apparatus conveys the disk 104 along a horizontal, linear path. Therefore, the disk feeder and disk collector must feed and collect the disk 104 at the upstream side and downstream side of the path, respectively, occupying an exclusive space each. This makes the entire image forming apparatus bulky, as discussed earlier.

Figure 2:
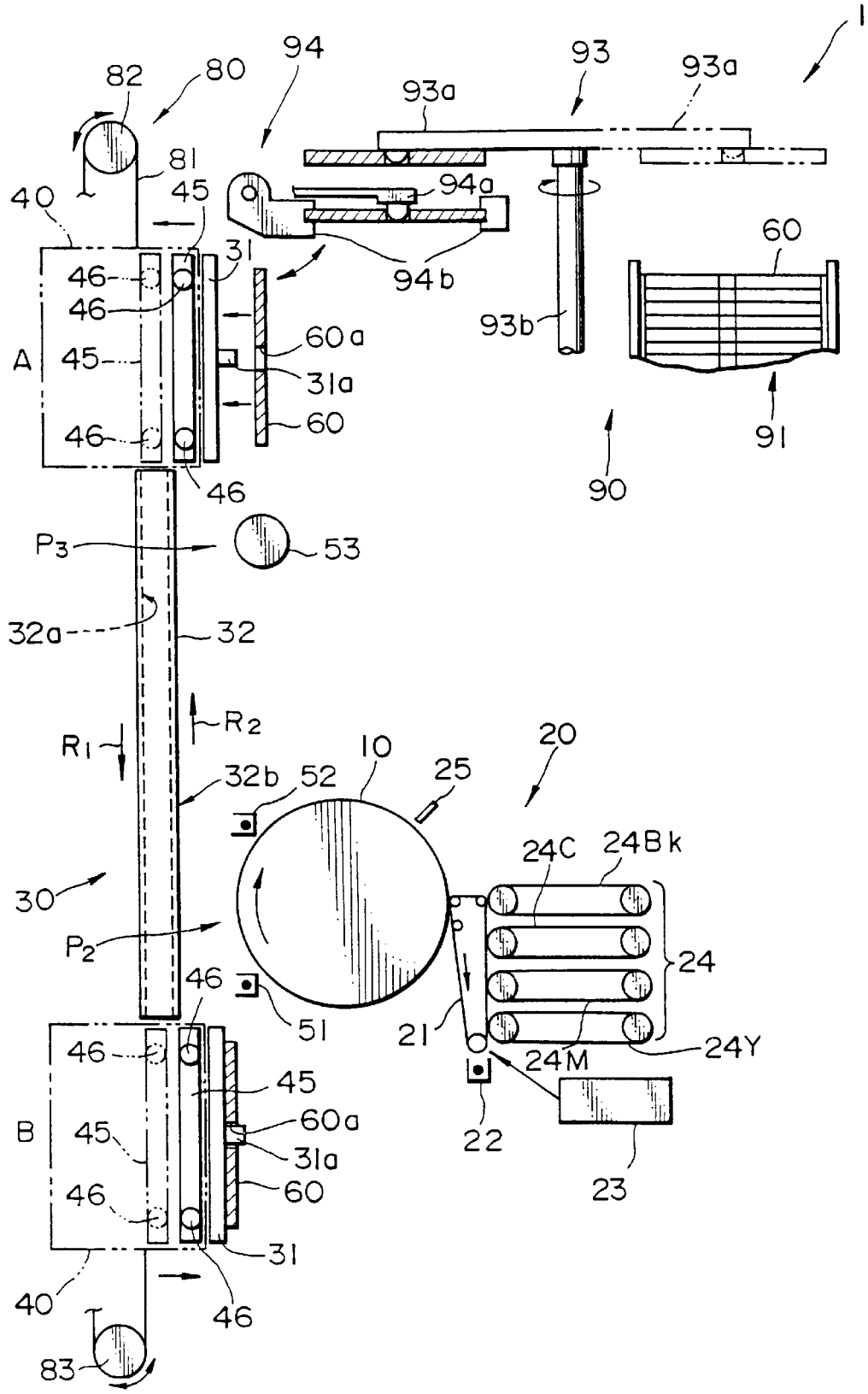
FIG. 2 is a view showing an image forming apparatus for synthetic resin sheets embodying the present invention.

Referring to FIG. 2, an image forming apparatus for synthetic resin sheets will be described hereinafter. In the illustrative embodiment, as well as in alternative embodiments to follow, the image forming apparatus is implemented as a label printer for printing a color label image on the surface of an optical disk by way of example.

As shown in FIG. 2, the label printer, generally 1, includes an intermediate image transfer drum (simply drum hereinafter) 10, which is a specific form of an image carrier. The drum 10 is rotatable in a direction indicated by an arrow in FIG. 2. An image forming section 20 forms a toner image on the drum 10. A conveyor 30 conveys an optical disk 60 along a substantially vertical path. Two transfer chargers 51 and 52 constitute an image transferring device for transferring the toner image from the drum 10 to the disk 60. A heat roller 53 representative of a fixing device fixes the toner image on the disk 60. A disk feeder/collector 90 feeds and then collects the disk 60, as will be described specifically later.

The image forming section 20 includes a photoconductive belt 21, which is another specific form of an image carrier. Arranged around the belt 21 are a main charger or charging means 22, an optical writing unit or latent image forming means 23, four developing units or developing means, collectively 24, and a drum cleaner 25. The main charger 22 uniformly charges the surface of the belt 21. The optical writing unit 23 electrostatically forms a latent image on the charged surface of the belt 21 by scanning it with a laser beam in accordance with image data. The developing units 24, i.e., developing units 24C (cyan), 24M (magenta), 24Y (yellow) and 24Bk (black) respectively develop latent images sequentially formed on the belt 21 with a cyan, a magenta, a yellow and a black developer. The drum cleaner 25 cleans the surface of the drum 10.

In operation, assume that the image forming section forms a full-color image. Then, in response to a print signal received from the computer, the belt 21 starts rotating in the direction indicated by the arrow in FIG. 2. At the same time, the main charger 22 starts uniformly charging the surface of the belt 21 to a preselected negative potential by corona discharge. The drum 6 is rotated by the belt 21 at the same speed as the belt 21 in a direction indicated by an arrow in FIG. 2.

The optical writing unit 23 first scans the charged surface of the belt 21 with a laser beam L modulated in accordance with C image data, thereby forming a C latent image on the belt 21. The developing unit 24C develops the C latent image with the C developer charged to negative polarity, thereby forming a C toner image on the belt 21. The C toner image is transferred from the belt 21 to the drum 10 at a primary image transfer position P1 where the belt 21 and drum 10 face each other (primary image transfer hereinafter). Specifically, a preselected electric field for primary image transfer is formed at the primary image transfer position P1 in synchronism with the conveyance of the C toner image. As a result, the C toner image is electrostatically transferred to the drum 10. A belt cleaner, not shown, cleans the surface of the belt 21 after the primary image transfer.

The writing unit 23 forms a M latent image on the belt 21 in parallel with the primary transfer of the C toner image to the drum 10. The developing unit 24M develops the M latent image with the M developer. The resulting M toner image is transferred from the belt 21 to the drum 10 over the C toner image at the primary image transfer position P1. Subsequently, a Y and a Bk toner image are sequentially transferred to the drum 10 in the same manner as the C and M toner images. Consequently, a full-color toner image is completed on the intermediate transfer drum 10.

A controller, not shown, controls the various operation timings of the image forming section 20, e.g., the write timing of the writing unit 23 and the timing for applying a bias for development. While the above description has concentrated on a full-color image, the label printer is, of course, capable of printing a monochromatic image in, e.g., black or an image in two or three colors.

At a secondary image transfer position $P_2$, the toner image is transferred from the drum 10 to the disk 60 being conveyed by the conveyor 30 (secondary image transfer), which will be described specifically later. At this instant, at least one of the transfer chargers 51 and 52 deposits preselected charge on the surface of the disk 60. The heat roller 53 fixes the toner image transferred to the disk 60 with heat and pressure at a fixing position $P_3$.

The conveyor 30 includes a table or holding member 31. A rail 32 has a generally U-shaped cross-section and plays the role of a guide that forms a path for disk conveyance. A path switching mechanism 40 switches the position of the disk 60, i.e., a guide position for the table 31 between a feed path or first conveyance path R1 and a return path or second conveyance path R2. A drive mechanism 80 includes a drive belt 81 for moving the table 31 and switching mechanism 40 integrally along a shaft not shown. The drive belt 81 is passed over an upper roller 82 and a lower roller 83, one of which is a reversible drive roller.

The table 31 has a support surface for supporting the disk 60. The support surface is covered with a silicone rubber layer and formed with a plurality of suction ports. The suction ports are fluidly communicated to an air pump via a pressure sensor although not shown specifically. The table 31 therefore holds the disk 60 on the support surface by suction. The disk 60 is positioned on the table 31 with a center hole 60*a* thereof mating with a pin 31*a,* which is studded on the table 31.

The disk feeder/collector 90 includes a feed box 91, a collection box, not shown, and a first and a second feeding/collecting mechanism 93 and 94. The feed box 91 and collection box store the disks 60 not processed and processed, respectively. The first and second feeding/ collecting mechanisms 93 and 94 pick up one unprocessed disk 60 from the feed box 91 at a time and load it on the table 31. Also, the feeding/collecting mechanisms 93 and 94 pick up the processed disk D from the table 31 and store it in the collection box.

More specifically, a plurality of disks 60 are stacked in the feed box 91. A first robot arm 93*a* included in the first feeding/collecting mechanism 93 picks up the top disk 60 and then makes half a rotation about a shaft 93*b*. At this position, a clamper 94*b* included in the second feeding/collecting mechanism 94 clamps the disk 60 and hands it over to a second robot arm 94*a* also included in the mechanism 93. The second robot arm 94*a* angularly moves downward in a direction indicated by an arrow in FIG. 2 to thereby load the disk 60 on the table 31.

Also, the feeding/collecting mechanisms 93 and 94 are controlled in a sequence opposite to the above-described sequence in order to collect the disk 60 carrying an image thereon in the collection box.

At a feed/collection position A located at an upper portion, as seen in FIG. 2, the table 31 holds the disk 60 fed from the disk feeder/collector 90 by suction. The table 31 is formed with an annular positioning groove, not shown, capable of mating with a stack ring or annular projection, not shown, formed on the disk 60. This allows the disk 60 to be positioned on the table 31. When suction pressure acting on the disk 60 exceeds a preselected value or varies, the pressure sensor mentioned earlier senses it and outputs a signal representative of a suction error. In response, the label printer stops operating while displaying, e.g., an error message on an operation panel not shown. If the table 31 is free from a suction error, then the path switching mechanism 40 repositions the table 31 relative to the rail 32. The conveyor 30 then conveys the table 31 substantially vertically toward a return position B located at a lower portion, as seen in FIG. 2.

Figure 3A:
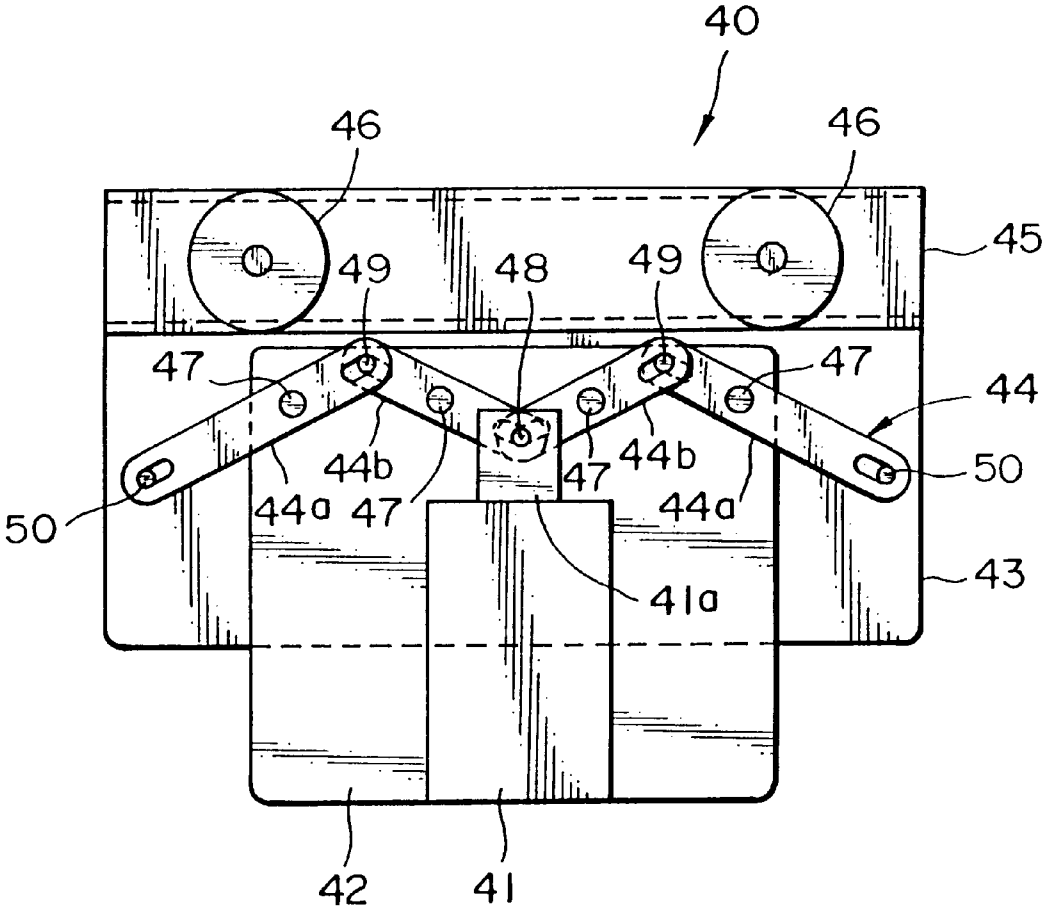
Figure 3B:
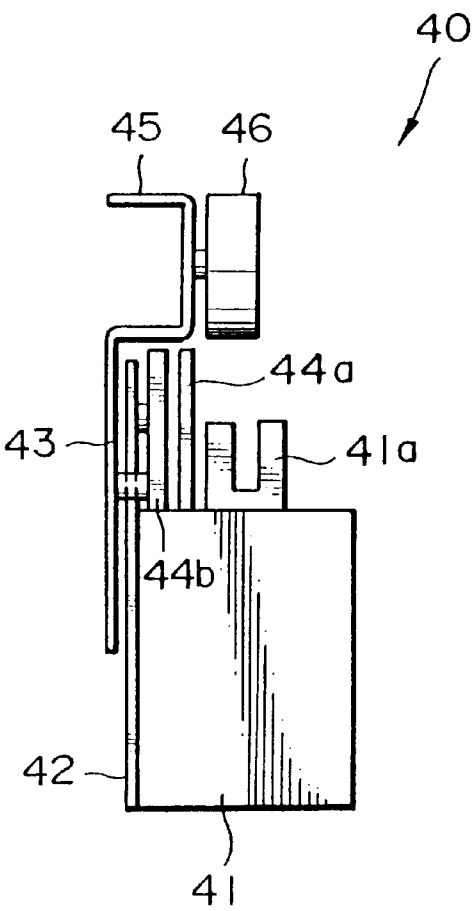
FIG. 3B is a side elevation of the path switching means.

As shown in FIGS. 3A and 3B, the path switching mechanism 40 includes an electromagnetic solenoid 41 mounted on a base 42. A slider 43 is slidable relative to the base 42. A link mechanism 44 transfers the drive force of the solenoid 41 to the slider 43. The slider 43 includes an engaging portion 45 having a generally U-shaped cross-section. Rollers 46 are received in the engaging portion 45 and roll on the rail 32. The table 31 is affixed to the slider 43. The link mechanism 44 includes two longer shafts 44*a* and two shorter shafts 44*b* that are pivotable about stubs 47, which are studded on the base 42.

Figure 4:
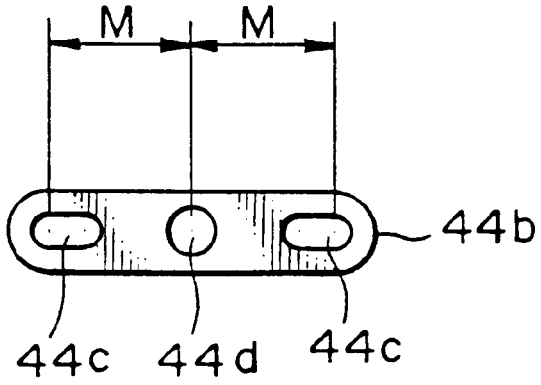
FIG. 4 is a front view showing one of shorter shafts included in a link mechanism that forms part of the path switching means.
Figure 5:
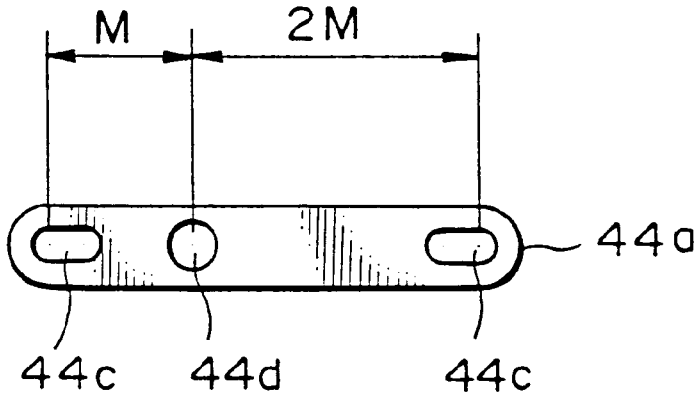
FIG. 5 is a front view showing one of longer shafts also included in the link mechanism.

As shown in FIG. 4, elongate slots 44*c* are formed in opposite end portions of each shorter shaft 44*b*. A hole 44*d* for receiving one shaft 47 is formed in the intermediate point of each shaft 44*b*, i.e., at an equal distance M from the slots 44*c*. As shown in FIG. 5, elongate slots 44*c* are formed in opposite end portions of each longer shaft 44*a*. A hole 44*d* for receiving another shaft 47 is formed in a particular position of each longer shaft 44*a* spaced from one slot 44*c* by a distance 2M and spaced from the other slot 44*c* by a distance M, i.e., in a 2:1 position in a distance.

Figure 6B:
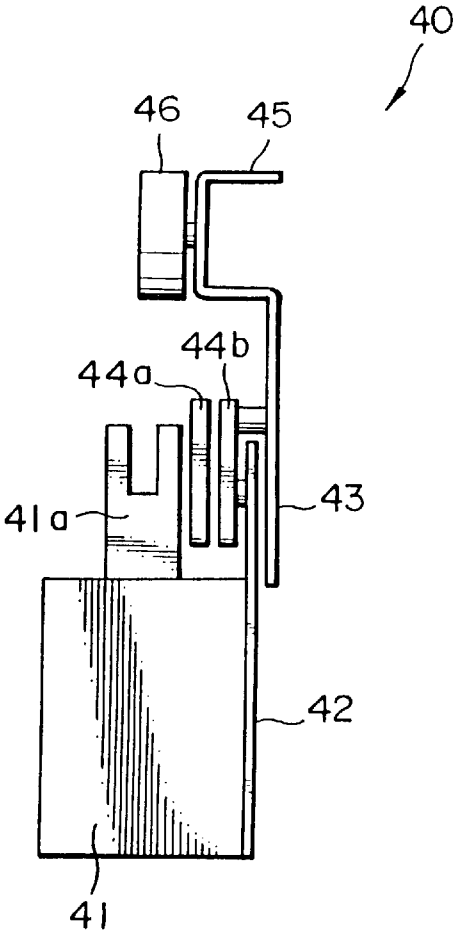
FIG. 6B is a side elevation showing the path switching means of FIG. 6A.
Figure 6A:
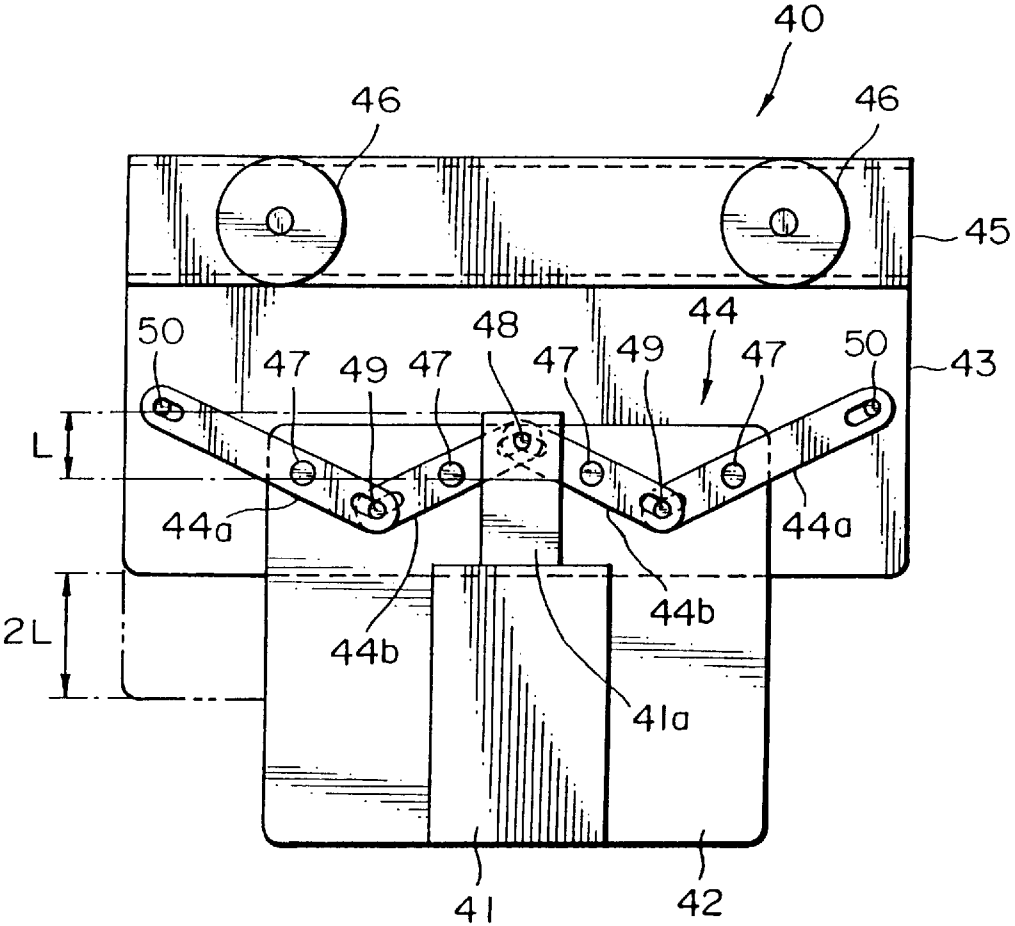
FIG. 6A is a view similar to FIG. 3A, showing the path switching means in a condition wherein the solenoid is turned off.

Referring again to FIGS. 3A and 3B, one end of each shorter shaft 44*b* is connected to a plunger 41*a* included in the solenoid 41 by a pin 48. The other end of each shorter shaft 44*b* is connected to the end of the associated longer shaft 44*a* closer to the hole 44*d* by a pin 49. The other end of each longer shaft 44*a* remote from the hole 44*d* is connected to the slider 43 by a pin 50. FIGS. 3A and 3B show a condition wherein the solenoid 41 is turned on. As shown in FIGS. 6A and 6B, when the solenoid 41 is turned off, the plunger 41*a* protrudes from the solenoid 41 by a stroke L. In this case, the slider 43 is displaced by a distance 2 L because of the 2:1 position of the hole 44*d* formed in each longer shaft 44*a*.

The operation of the conveyor 30 will be described with reference to FIG. 2. Assume that the table 31 located at the feed/collection position A is free from a suction error. Then, the path switching mechanism 40 is operated to shift the slider 43 from a position indicated by a solid line in FIG. 2 to a position indicated by a dash-and-dots line, thereby bringing the engaging portion 45 of the slider 43 into the rail 32. Stated another way, the switching mechanism 40 selects the feed path or first conveyance path $R_1$ and causes the rail 32 to guide the engaging portion 45 with its inner periphery 32*a*. In this condition, the disk 60 is conveyed from the feed/collection position A to the return position B while being spaced from the secondary image transfer position P2 between the transfer chargers 51 and 52 and the fixing position $P_3$assigned to the heat roller 53.

Why the disk 60 is conveyed along the feed path $R_1$ spaced from the secondary image transfer position $P_2$ and fixing position $P_3$ will be described hereinafter. In the illustrative embodiment, the drum 10 and heat roller 53 rotate in a direction opposite to the direction of movement of the table 31 from the feed position A to the return position B for image forming process reasons. The disk 60 bites into the drum 10 during secondary image transfer and bits into the heat roller 53 during fixation. Therefore, should the disk 60 be conveyed toward the return position B without the path being switched, mechanical interference would occur between the drum 10 and heat roller 53 and the disk 60 and would thereby damage both of them.

When the disk 60 arrives at the return position, or print start position, B, the path switching mechanism 40 is again operated to shift the engaging portion 45 to the solid line position out of the rail 32. Stated another way, the path switching mechanism 40 selects the return path or second conveyance path $R_2$. The conveyor 30 then conveys the table 26 toward the feed/collection position A along the return path $R_2$. At this instant, the rail 32 guides the engaging portion 45 with its outer periphery 32b. At the secondary image transfer position $P_2$, the transfer chargers 51 and 52 uniformly charge the disk 60, so that a toner image is electrostatically transferred from the drum 10 to the disk 60. At the fixing position $P_3$, the heat roller 53 fixes the toner image on the disk 60 with heat and pressure. Subsequently, when the disk 60 reaches the feed/collection position A, the disk feeder/collector 90 picks up the disk 60 and stores it in the collection box.

Figure 7:
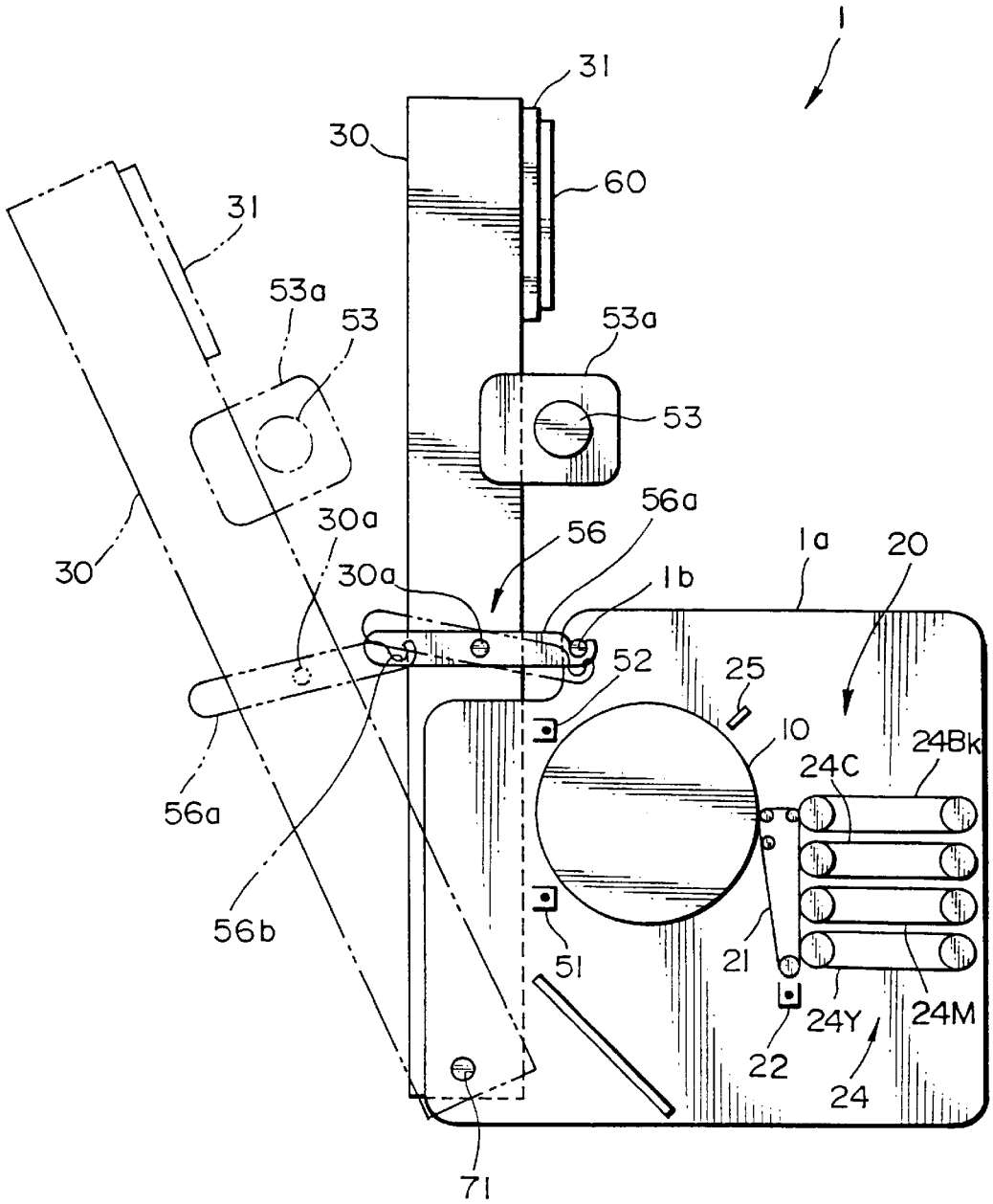
FIG. 7 is a front view showing a modification of the illustrative embodiment.

FIG. 7 shows a modification of the illustrative embodiment. As shown, a printer body 1*a* (not shown in FIG. 2) rotatably supports the lower end of the conveyor 30 via a shaft 71. The heat roller 53 is mounted on the conveyor 30 via a bracket 53*a* (not shown in FIG. 2). A locking mechanism 56 usually locks the conveyor 30 to the printer body 1*a*. The locking mechanism 56 includes a lever 56*a* rotatably mounted on the frame of the conveyor 30 via a shaft 30*a* and a pin 1*b* studded on the printer body 1*a*. A hook 56*b* is formed at one end of the lever 56*a*. When the hook 56*b* is engaged with the pin 1*b*, the conveyor 30 is locked to the printer body 1*a*.

Specifically, in the event of a suction error as sensed by the pressure sensor, the disk 60 is apt to drop from the table 31 due to the vertical conveyance path. If the conveyor 30 is affixed to the printer body 1*a*, then the operator of the label printer 1 cannot pick up the disk 60 dropped from the table 31. In the modification shown in FIG. 7, the operator can unlock the locking mechanism 56 and then angularly move the conveyor 30 away from the printer body 1*a* to a position indicated by a dash-and-dots line. This allows the operator to easily pick up the disk 60 dropped from the table 31.

As stated above, in the illustrative embodiment, the disk 60 can be fed to and collected from the conveyance path at the same feed/collection position A. A single space therefore suffices for both of the feed and collection of the disk 60, promoting the compact configuration of the label printer 1. Further, the disk 60 is conveyed from the above position A to the return position B along the feed path $R_1$ that does not include the image transfer position or the fixing position. This successfully prevents the disk 60 from interfering with the drum 10 and heat roller 53 when an image is not transferred to the drum 10.

Figure 8:
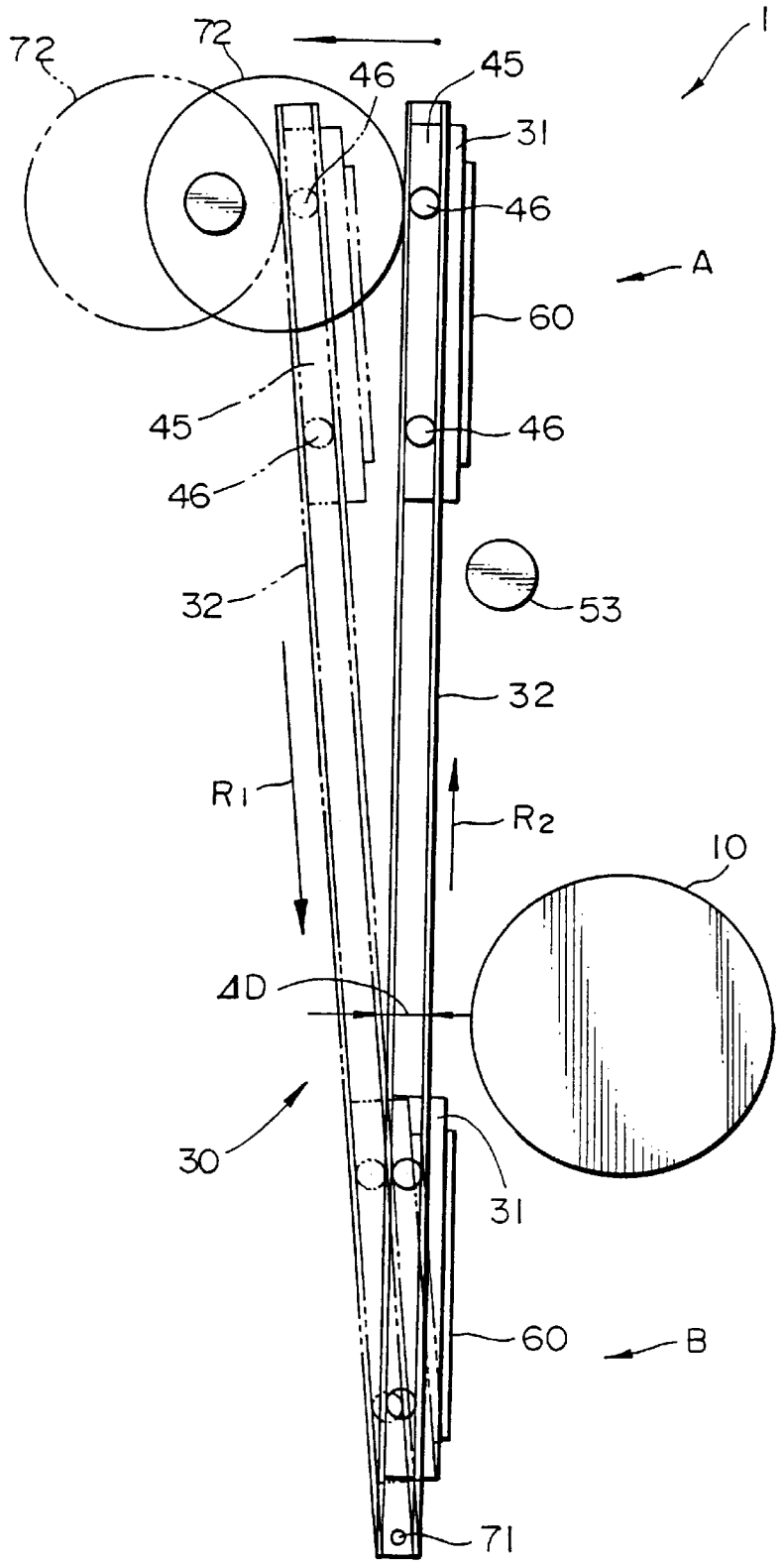
FIG. 8 is a view showing an alternative embodiment of the present invention.

Reference will be made to FIG. 8 for describing an alternative embodiment of the present invention. Assume that the pressure sensor senses a suction error while fixation is under way. Then, the label printer stops operating and shuts of power supply to a heater included in the heat roller 53. However, the heat roller 53 is not sharply cooled off, so that the disk 60 is apt to deform due to heat. The illustrative embodiment is constructed to solve this problem. In the illustrative embodiment, structural elements identical with the structural elements of the previous embodiment are designated by identical reference numerals and will not be described specifically in order to avoid redundancy.

As shown in FIG. 8, the rail 32 has its lower end rotatably supported by the shaft 71. A spring or similar biasing means, not shown, constantly biases the rail 32 away from the drum 10 and heat roller 53. An eccentric cam 72 is implemented as a disk and operatively connected to a drive source or drive means not shown. The drive source may be implemented by a motor by way of example. The circumference of the eccentric cam 72 contacts the upper portion of the rail 32 or the upper portion of a conveying unit including the rail 32.

The disk 60 is usually 1.2 mm thick or so. It follows that the cam 72 should preferably displace the rail 32 by a distance ΔD of about 3 mm including some margin, as measured at the position where the rail 32 faces the drum 10. The diameter of the cam 72 may be varied to set up an adequate displacement of the rail 32. The displacement ΔD may even be 10 mm to 20 mm, if desired. A roller or a bearing is mounted on the portion of the rail 32 or the portion of the conveying unit held in contact with the cam 72. The rotation of the cam 72 is controlled in accordance with the output of, e.g., an encoder that will be described later.

When the disk 60 located at the feed/collection position is free from a suction error, the drive source causes the cam 72 to rotate to a position indicated by a dash-and-dots line in FIG. 8. As a result, the conveyance path is switched from the return path $R_2$to the feed path $R_1$ that does not include the secondary image transfer position or the fixing position.

In the illustrative embodiment, too, the disk 60 can be fed to and collected from the conveyance path at the same feed/collection position A. A single space therefore suffices for both of the feed and collection of the disk 60, promoting the compact configuration of the label printer 1. Further, the disk 60 is prevented from interfering with the drum 10 and heat roller 53 when an image is not transferred to the drum 10. In addition, the simple rotation of the cam 72 can switch the conveyance path alone.

Figure 9:
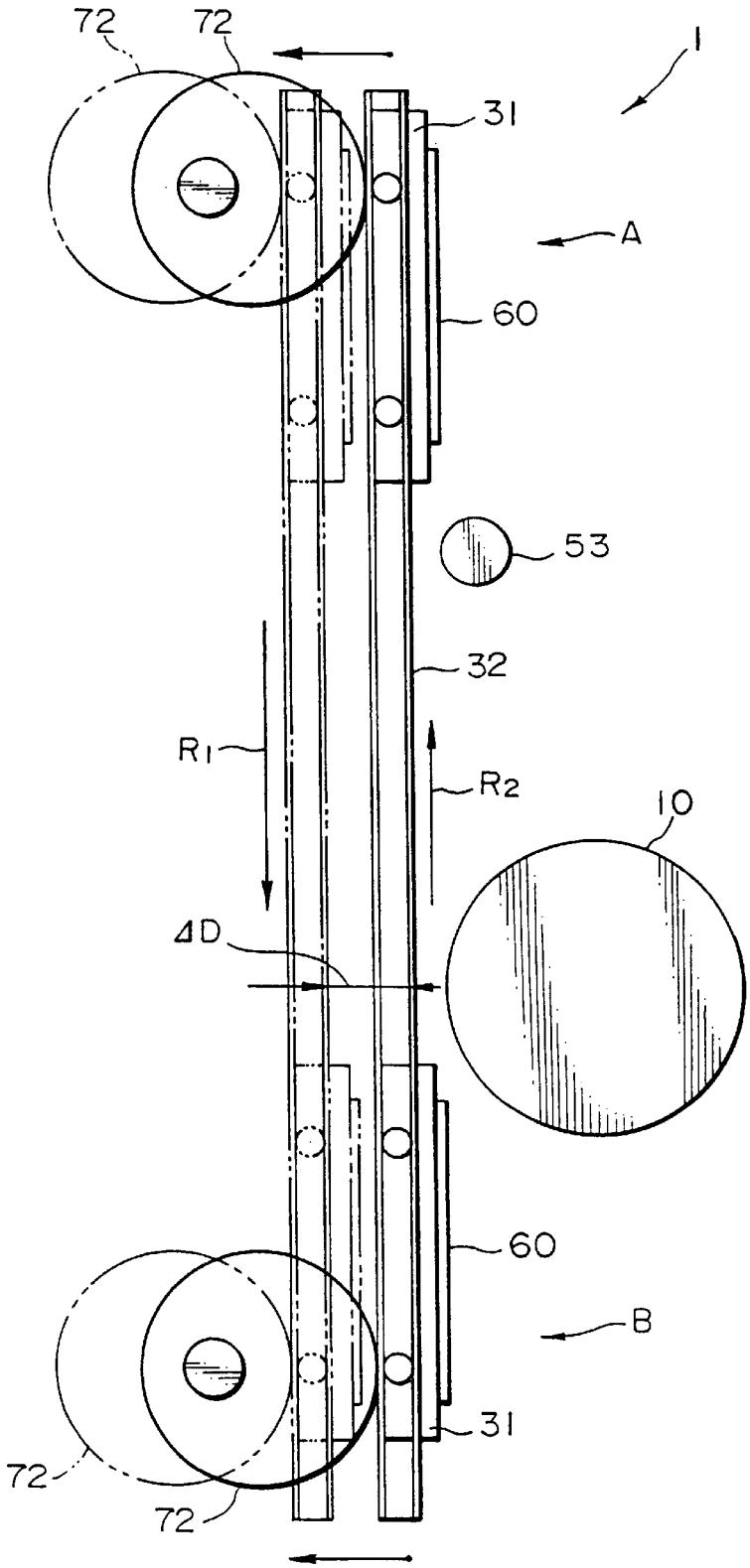
FIG. 9 is a view showing a modification of the alternative embodiment.

The eccentric cam 72 may be provided with any desired shape other than the disk shape. FIG. 9 shows a modification of the illustrative embodiment. As shown, two eccentric cams 72 contact opposite end portions of the rail 32. In this configuration, if the disk 60 is free from a suction error, then the cams 72 shift the entire rail 32 away from the secondary transfer position and fixing position.

Figures 10A, 10B:
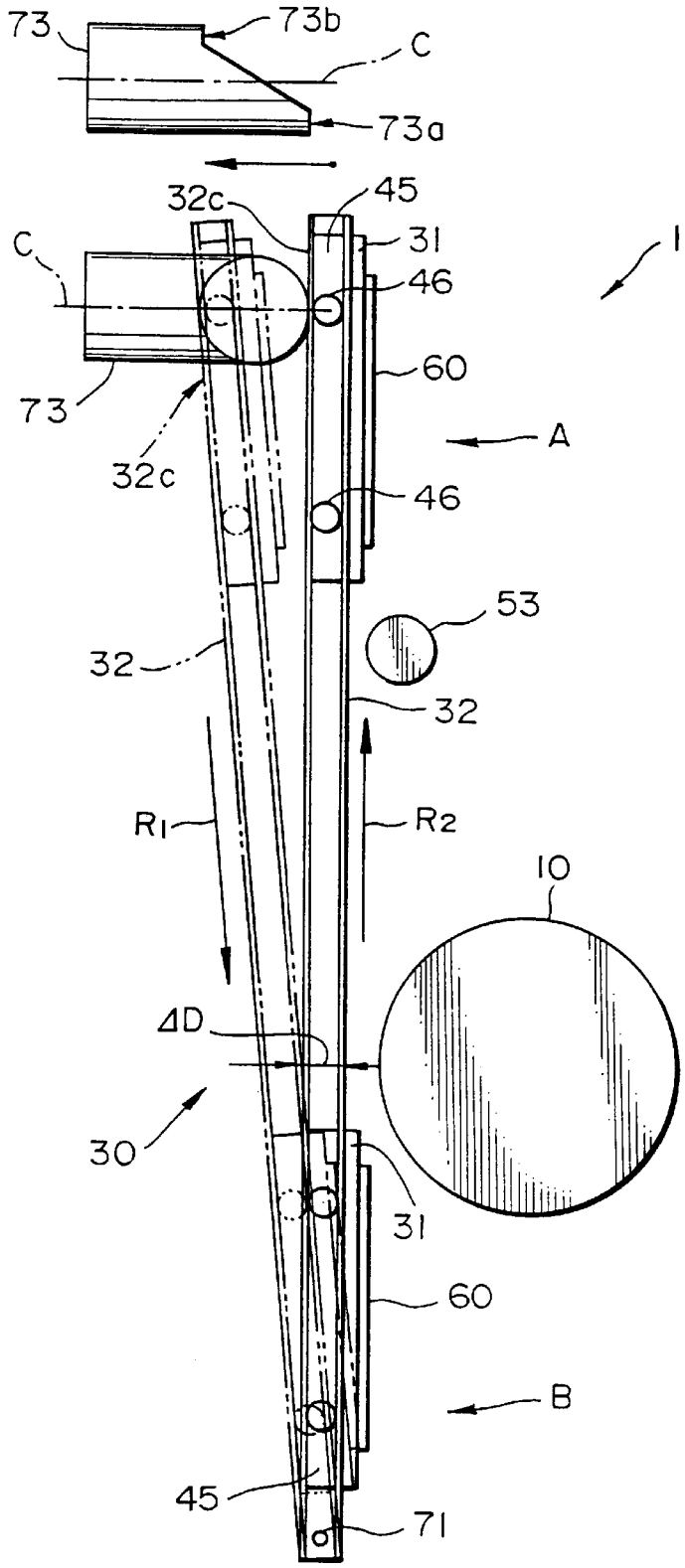
FIG. 10A is a view showing another alternative embodiment of the present invention.
FIG. 10B is a plan view of a cylindrical cam included in the embodiment shown in FIG. 10A.
Figure 11:
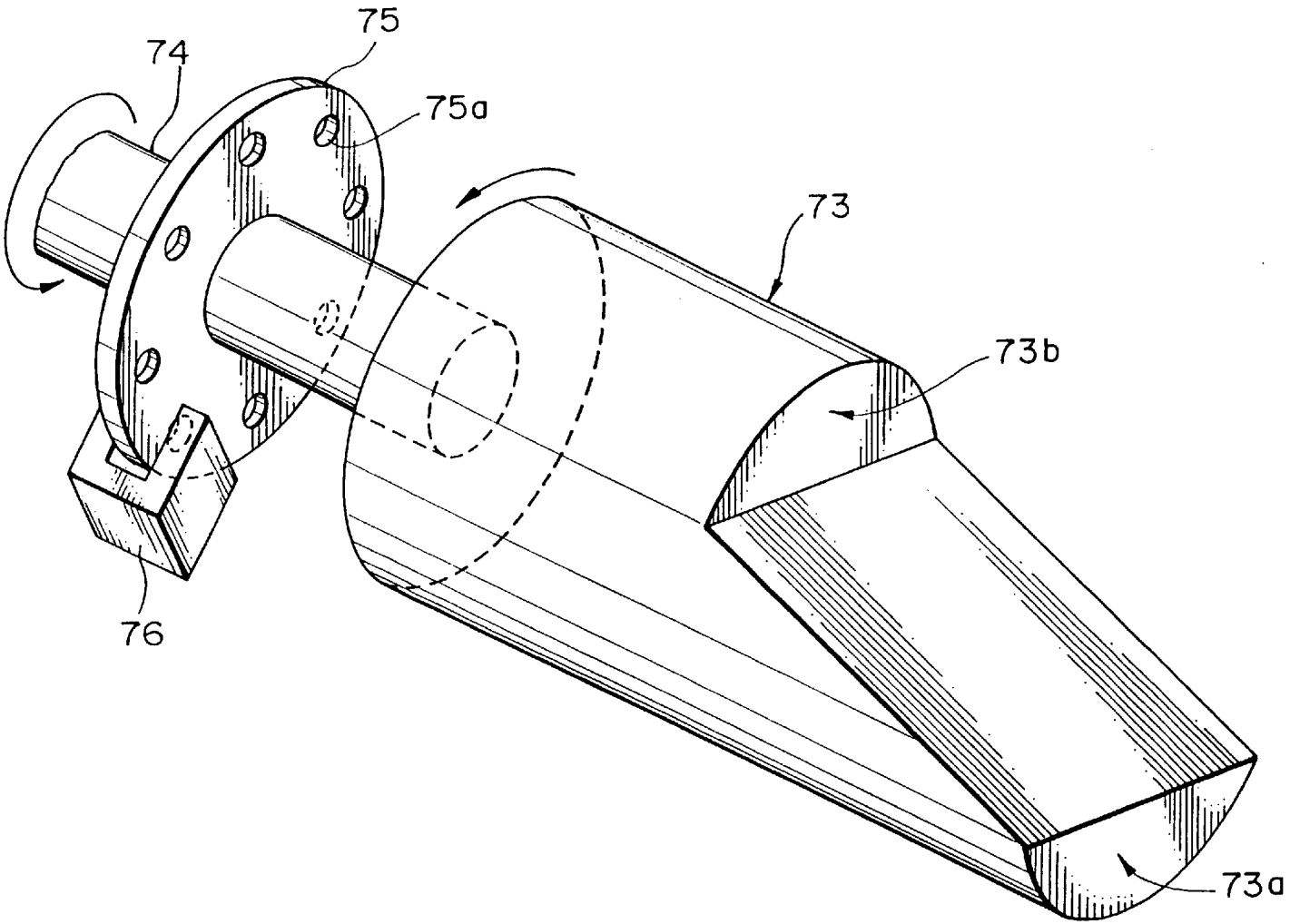
FIG. 11 is a perspective view showing the cam and an encoder also included in the embodiment of FIG. 10A.

Reference will be made to FIGS. 10A, 10B and 11 for describing another alternative embodiment of the present invention. In the illustrative embodiment, structural elements identical with the structural elements of the previous embodiments are designated by identical reference numerals and will not be described specifically in order to avoid redundancy. As shown, the shaft 71 rotatably supports the lower end of the rail 32, as in the embodiment shown in FIG. 8. A spring or similar biasing means, not shown, constantly biases the rail 32 away from the drum 10 and heat roller 53.

In the illustrative embodiment, a cylindrical cam 73 having end faces 73*a* and 73*b* contacts the upper portion of the rail 32 or that of a conveying unit including the rail 32. The cam 73 is connected to a motor or similar drive source or drive means not shown. The cam 73 has an axis C extending in the direction in which it presses the rail 32, and rotates about the axis C. When the rail 32 is shifted to a first guide position (solid line) assigned to secondary image transfer and fixation, the cam 73 rotates a predetermined angle until the end face or projection 73*a* thereof contacts the outer periphery 32*c* of the rail 32. On the other hand, when the rail 32 is shifted to a second guide position (dash-and-dots line) assigned to a condition other than secondary image transfer and fixation, the cam 73 rotates 180° until the end face or recess 73*b* contacts the outer periphery 32*c* of the rail 32.

As shown in FIG. 11 specifically, an encoder is mounted on a drive shaft 74 that drives the cam 73 and made up of a disk 75 and a photosensor 76. The disk 75 is formed with holes 75*a* at equally spaced locations along the circumference (at intervals of 45° in the illustrative embodiment). The photosensor has a light emitting portion and a light-sensitive portion located at opposite sides with respect to the portion of the disk 75 formed with the holes 75*a*. When the cam 73 is caused to rotate, the photosensor 76 senses the holes of the disk 75. The drive source assigned to the cam 73 is controlled in accordance with the output of the photosensor 76, so that the cam 73 can be accurately rotated to a preselected position.

In the illustrative embodiment, too, the disk 60 can be fed to and collected from the conveyance path at the same feed/collection position A. A single space therefore suffices for both of the feed and collection of the disk 60, promoting the compact configuration of the label printer 1. Further, the disk 60 is prevented from interfering with the drum 10 and heat roller 53 when an image is not transferred to the drum 10. In addition, the simple rotation of the cam 73 can switch the conveyance path alone.

In the embodiments shown and described, the conveyor is substantially positioned at an angle of 90° with respect to horizontal. Alternatively, the conveyor may be positioned at any suitable angle within a range above 0° C., but equal to or below 90° C. While the feed/collection position is located at the end of the return path or second conveyance path $R_2$, it may alternatively be positioned at the beginning of the same path $R_2$. For example, in FIG. 2, the disk 60 may be fed and collected at the position B.

Further, the drum 10 playing the role of an image carrier may be replaced with an intermediate image transfer belt passed over a plurality of rollers. Likewise, the photoconductive belt 21 shown in FIG. 2 may, of course, be replaced with a photoconductive drum. Moreover, the present invention is similarly practicable with an image forming apparatus of the type transferring a toner image from the photoconductive drum or belt directly to an optical disk or similar synthetic resin sheet. In addition, the disk 60 maybe replaced with, e.g., a cash card, IC card, ID card, telephone card or similar card.

In summary, it will be seen that the present invention provides an image forming apparatus for synthetic resin sheets having various unprecedented advantages, as enumerated below.

(1) The apparatus feeds and collects a synthetic resin sheet from a conveyance path at the same position. A single space therefore suffices for both of the feed and collection of the synthetic resin sheet, promoting the compact configuration of the apparatus. The conveyance path is inclined relative to the horizontal plane and therefore saves space to thereby promote the efficient use of a limited floor area. When the conveyance path is inclined by 90°, a limited floor are can be most efficiently used.

(2) When an image is not formed on the synthetic resin sheet, the sheet is fed from the end position of conveyance to the start position of conveyance without being passed through an image transfer position or a fixing position. This prevents the synthetic resin sheet from conflicting with an image transferring device or a fixing device.

(3) When an error has occurred, at least a table included in a conveyor is spaced from the image transferring device or the fixing device, protecting the synthetic resin sheet from damage due to, e.g., heat.

(4) When the synthetic resin sheet drops, the operator of the apparatus can easily pick it up. In addition, a trouble ascribable to the dropped sheet is obviated.

Various modifications will become possible for those skilled in the art after receiving the teachings of the present disclosure without departing from the scope thereof.

What is claimed is:

1. An image forming apparatus comprising:

an image carrier;

image forming means for forming a toner image on said image carrier;

conveying means for conveying a synthetic resin sheet;

image transferring means for transferring the toner image from said image carrier to the synthetic resin sheet; and fixing means for fixing the toner image on the synthetic resin sheet, wherein said conveying means has a conveyance path inclined relative to a horizontal plane, and wherein said conveying means comprises path switching means for selecting either one of a feed path and a return path included in said conveyance path.

2. The apparatus as claimed in claim 1, wherein said conveyance path is inclined by substantially 90° relative to the horizontal plane.

3. The apparatus as claimed in claim 1, wherein said conveying means returns the synthetic resin sheet at a position close to said image forming means, and wherein a position for feeding the synthetic resin sheet and a position for collecting said synthetic resin sheet are located at a same side.

4. The apparatus as claimed in claim 3, wherein said fixing means is positioned downstream of said image forming means with respect to a return path included in said conveyance path.

5. The apparatus as claimed in claim 1, wherein said conveyance path comprises a single rail, one periphery of which constitutes a guide surface during feed and the other periphery of which constitutes a guide surface during return.

6. The apparatus as claimed in claim 1, wherein said conveying means conveys the synthetic resin sheet by sucking said synthetic resin sheet.

7. The apparatus as claimed in claim 6, wherein said apparatus stops operating in response to an error signal representative of a change in suction pressure.

8. The apparatus as claimed in claim 7, further comprising releasing means for releasing, in the event of an error, at least a portion of said conveying means holding the synthetic resin sheet from said image transferring means and said fixing means.

9. The apparatus as claimed in claim 1, wherein said conveying means is angularly movable about one end thereof.

10. An image forming apparatus comprising:

an image carrier;

image forming means for forming a toner image on said image carrier;

conveying means for conveying a synthetic resin sheet along a preselected path;

image transferring means for transferring the toner image from said image carrier to the synthetic resin sheet being conveyed by said conveying means; and fixing means for fixing the toner image on the synthetic resin sheet, wherein said conveying means is constructed such that the synthetic resin sheet is fed and collected from said conveyance path at a same position, wherein said conveyance path comprises a first conveyance path for conveying the synthetic resin sheet via an image transfer position and a fixing position where said image transferring means and said fixing means are respectively located, and a second conveyance path for returning the synthetic resin sheet from an end position of said first conveyance path without passing said synthetic resin sheet through the image transfer position or the fixing position, and wherein the synthetic resin sheet is fed and collected at either one of the end position or the start position of said first conveyance path.

11. The apparatus as claimed in claim 10, wherein said conveying means comprises:

a holding member for holding the synthetic resin sheet;

a guide member including a first guide portion for guiding said holding member such that the synthetic resin sheet moves along said first conveyance path, and a second guide portion for guiding said holding member such that said synthetic resin sheet moves along said second conveyance path; and drive means for driving said holding member such that said holding member moves by being guided by either one of said first guide portion and said second guide portion.

12. The apparatus as claimed in claim 10, wherein said conveying means comprises:

a holding member for holding the synthetic resin sheet;

a guide member movable between a first guide position for guiding said holding member such that the synthetic resin sheet moves along said first conveyance path and a second guide position for guiding said holding member such that said synthetic resin sheet moves along said second conveyance path;

path switching means for selecting either one of said first guide position and said second guide position; and drive means for driving said holding member such that said holding member moves by being guided by said guide member.

13. The apparatus as claimed in claim 12, wherein said guide member is angularly movable about one end thereof.

14. The apparatus as claimed in claim 13, wherein said path switching means comprises:

biasing means for constantly biasing said guide member toward either one of said first guide position and said second guide position; and pressing means for pressing a free end portion of said guide member against an action of said biasing means such that said guide member angularly moves toward the other of said first guide position and said second guide position.

15. The apparatus as claimed in claim 14, wherein said pressing means comprises a disk-like cam rotatable about an axis perpendicular to a direction in which said pressing means presses said guide member, and drive means for causing said cam to rotate.

16. The apparatus as claimed in claim 14, wherein said pressing means comprises a cylindrical cam rotatable about an axis parallel to a direction in which said pressing means presses said guide member, and having a cam profile that contacts the free end portion of said guide member, and drive means for causing said cam to rotate.

17. An image forming apparatus comprising:

an image carrier;

an image forming section constructed to form a toner image on said image carrier;

a conveyor constructed to convey a synthetic resin sheet;

an image transferring device constructed to transfer the toner image from said image carrier to the synthetic resin sheet; and a fixing device constructed to fix the toner image on the synthetic resin sheet, wherein said conveyor has a conveyance path inclined relative to a horizontal plane, and wherein said fixing device is positioned downstream of said image forming section with respect to a return path included in said conveyance path.

18. The apparatus as claimed in claim 17, wherein said conveyance path is inclined by substantially 90° relative to the horizontal plane.

19. The apparatus as claimed in claim 17, wherein said conveyor returns the synthetic resin sheet at a position close to said image forming section, and wherein a position for feeding the synthetic resin sheet and a position for collecting said synthetic resin sheet are located at a same side.

20. The apparatus as claimed in claim 19, wherein said conveyor comprises a path switching mechanism for selecting either one of a feed path and a return path included in said conveyance path.

21. The apparatus as claimed in claim 20, wherein said conveyance path comprises a single rail one periphery of which constitutes a guide surface during feed and the other periphery of which constitutes a guide surface during return.

22. The apparatus as claimed in claim 17, wherein said conveyor conveys the synthetic resin sheet by sucking said synthetic resin sheet.

23. The apparatus as claimed in claim 22, wherein said apparatus stops operating in response to an error signal representative of a change in suction pressure.

24. The apparatus as claimed in claim 23, further comprising a releasing mechanism for releasing, in the event of an error, at least a portion of said conveyor holding the synthetic resin sheet from said image transferring device and said fixing device.

25. The apparatus as claimed in claim 17, wherein said conveyor is angularly movable about one end thereof.

26. An image forming apparatus comprising:

an image carrier;

an image forming section constructed to form a toner image on said image carrier;

a conveyor constructed to convey a synthetic resin sheet along a preselected path;

an image transferring device constructed to transfer the toner image from said image carrier to the synthetic resin sheet being conveyed by said conveyor; and a fixing device constructed to fix the toner image on the synthetic resin sheet, wherein said conveyor is constructed such that the synthetic resin sheet is fed and collected from said conveyance path at a same position, wherein said conveyance path comprises a first conveyance path for conveying the synthetic resin sheet via an image transfer position and a fixing position where said image transferring device and said fixing device are respectively located, and a second conveyance path for returning the synthetic resin sheet from an end position of said first conveyance path to a start position of said first conveyance path without passing said synthetic resin sheet through the image transfer position or the fixing position, and wherein the synthetic resin sheet is fed and collected at either one of the end position or the start position of said first conveyance path.

27. The apparatus as claimed in claim 26, wherein said conveyor comprises:

a holding member configured to hold the synthetic resin sheet;

a guide member including a first guide portion for guiding said holding member such that the synthetic resin sheet moves along said first conveyance path, and a second guide portion for guiding said holding member such that said synthetic resin sheet moves along said second conveyance path; and a drive source configured to drive said holding member such that said holding member moves by being guided by either one of said first guide portion and said second guide portion.

28. The apparatus as claimed in claim 26, wherein said conveyor comprises:

a holding member configured to hold the synthetic resin sheet;

a guide member movable between a first guide position for guiding said holding member such that the synthetic resin sheet moves along said first conveyance path and a second guide position for guiding said holding member such that said synthetic resin sheet moves along said second conveyance path;

a path switching mechanism for selecting either one of said first guide position and said second guide position; and a drive source configured to drive said holding member such that said holding member moves by being guided by said guide member.

29. The apparatus as claimed in claim 28, wherein said guide member is angularly movable about one end thereof.

30. The apparatus as claimed in claim 29, wherein said path switching mechanism comprises:

a biasing member configured to constantly bias said guide member toward either one of said first guide position and said second guide position; and a pressing member configured to press a free end portion of said guide member against an action of said biasing member such that said guide member angularly moves toward the other of said first guide position and said second guide position.

31. The apparatus as claimed in claim 30, wherein said pressing member comprises a disk-like cam rotatable about an axis perpendicular to a direction in which said pressing member presses said guide member, and a drive source configured to cause said cam to rotate.

32. The apparatus as claimed in claim 30, wherein said pressing member comprises a cylindrical cam rotatable about an axis parallel to a direction in which said pressing member presses said guide member, and having a cam profile that contacts the free end portion of said guide member, and a drive source configured to cause said cam to rotate.

33. An image forming apparatus comprising:

an image carrier;

image forming means for forming a toner image on said image carrier;

conveying means for conveying a synthetic resin sheet;

image transferring means for transferring the toner image from said image carrier to the synthetic resin sheet; and fixing means for fixing the toner image on the synthetic resin sheet, wherein said conveying means has a conveyance path inclined relative to a horizontal plane, and wherein said conveying means conveys the synthetic resin sheet by sucking said synthetic resin sheet, and wherein said apparatus stops operating in response to an error signal representative of a change in suction pressure.

34. The apparatus as claimed in claim 33, further comprising releasing means for releasing, in the event of an error, at least a portion of said conveying means holding the synthetic resin sheet from said image transferring means and said fixing means.

35. An image forming apparatus comprising:

an image carrier;

an image forming section constructed to form a toner image on said image carrier;

a conveyor constructed to convey a synthetic resin sheet;

an image transferring device constructed to transfer the toner image from said image carrier to the synthetic resin sheet; and a fixing device constructed to fix the toner image on the synthetic resin sheet, wherein said conveyor has a conveyance path inclined relative to a horizontal plane, wherein said conveyor returns the synthetic resin sheet at a position close to said image forming section, and wherein a position for feeding the synthetic resin sheet and a position for collecting said synthetic resin sheet are located at a same side, and wherein said conveyor comprises a path switching mechanism for selecting either one of a feed path and a return path included in said conveyance path.

36. The apparatus as claimed in claim 35, wherein said conveyance path comprises a single rail one periphery of which constitutes a guide surface during feed and the other periphery of which constitutes a guide surface during return.

37. An image forming apparatus comprising:

an image carrier;

an image forming section constructed to form a toner image on said image carrier;

a conveyor constructed to convey a synthetic resin sheet; and an image transferring device constructed to transfer the toner image from said image carrier to the synthetic resin sheet; and a fixing device constructed to fix the toner image on the synthetic resin sheet, wherein said conveyor has a conveyance path inclined relative to a horizontal plane, wherein said conveyor conveys the synthetic resin sheet by sucking said synthetic resin sheet, and wherein said apparatus stops operating in response to an error signal representative of a change in suction pressure.

38. The apparatus as claimed in claim 37, further comprising a releasing mechanism for releasing, in the event of an error, at least a portion of said conveyor holding the synthetic resin sheet from said image transferring device and said fixing device.

* * * * *